US007150673B2

(12) United States Patent
Sakurai et al.

(10) Patent No.: US 7,150,673 B2
(45) Date of Patent: Dec. 19, 2006

(54) METHOD FOR ESTIMATING POLISHING PROFILE OR POLISHING AMOUNT, POLISHING METHOD AND POLISHING APPARATUS

(75) Inventors: Kunihiko Sakurai, Tokyo (JP); Tetsuji Togawa, Tokyo (JP); Yoshihiro Mochizuki, Fujisawa (JP); Akira Fukuda, Fujisawa (JP); Hirokuni Hiyama, Fujisawa (JP); Kazuto Hirokawa, Tokyo (JP); Manabu Tsujimura, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 11/176,184

(22) Filed: Jul. 8, 2005

(65) Prior Publication Data

US 2006/0009127 A1 Jan. 12, 2006

(30) Foreign Application Priority Data

Jul. 9, 2004 (JP) ..... 2004-202970

(51) Int. Cl.
*B24B 49/00* (2006.01)
*G06F 19/00* (2006.01)

(52) U.S. Cl. ..... 451/5; 700/164

(58) Field of Classification Search ..... 451/286, 451/5, 41, 6; 700/121, 164, 160, 174, 175, 700/195; 156/345
See application file for complete search history.

(56) References Cited

U.S. PATENT DOCUMENTS 5,605,488 A * 2/1997 Ohashi et al. ..... 451/7
5,695,601 A 12/1997 Kodera et al.
5,762,539 A * 6/1998 Nakashiba et al. ..... 451/41
5,908,530 A * 6/1999 Hoshizaki et al. ..... 156/345.14
5,943,230 A 8/1999 Rinnen et al.
6,230,069 B1 5/2001 Campbell et al.
6,468,131 B1 * 10/2002 Korovin ..... 451/5
6,476,921 B1 11/2002 Saka et al.
6,486,492 B1 11/2002 Su
6,594,542 B1 * 7/2003 Williams ..... 700/164
6,776,692 B1 8/2004 Zuniga et al.
2003/0023402 A1 * 1/2003 Kobayashi et al. ..... 702/167

OTHER PUBLICATIONS

Masahiro Kimura et al., "A New Method for the Precise Measurement of Wafer Roll off of Silicon Polished Wafer", J. Appl. Phys., vol. 38, pp. 38-39, Part 1, No. 1A, Jan. 1999 © 1999 Publication Board, Japanese Journal, of Applied Physics.

* cited by examiner

*Primary Examiner*—Jacob K. Ackun, Jr.
(74) *Attorney, Agent, or Firm*—Wenderoth, Lind & Ponack, L.L.P.

(57) ABSTRACT

A polishing method can automatically reset polishing conditions according to a state of a polishing member based on data on a polishing profile changing with time, thereby extending life of the polishing member and obtaining flatness of a polished surface with higher accuracy. The polishing method, includes steps of: independently applying a desired pressure by each of pressing portions of a top ring on a polishing object; estimating a polishing profile of the polishing object based on set pressure values, and calculating a recommended polishing pressure value so that a difference between the polishing profile of the polishing object after it is polished under certain polishing conditions and a desired polishing profile becomes smaller; and polishing the polishing object with the recommended polishing pressure value.

27 Claims, 8 Drawing Sheets

METHOD FOR ESTIMATING POLISHING PROFILE OR POLISHING AMOUNT, POLISHING METHOD AND POLISHING APPARATUS

BACKGROUND OF THE INVENTION

1. Field of the Invention

The present invention relates to a method for estimating and controlling a polishing profile or polishing amount during a polishing process of flatly polishing a surface of an interconnect material or an insulating film formed on a polishing object, such as a wafer, in manufacturing of a semiconductor device, and a polishing method and a polishing apparatus which employ the above method in performing polishing. The present invention also relates to a program for controlling a polishing apparatus, and a storage medium in which the program and data have been stored.

2. Description of the Related Art

In a CMP process of flatly polishing a surface of an interconnect material or an insulating film laminated on a substrate in manufacturing of a semiconductor device, polishing conditions employed in operation of a manufacturing line are previously optimized, and successive polishing operations of substrates are performed repeatedly under the same optimized polishing conditions until wear of a polishing member reaches its limit. However, in the course of wear of the polishing member, a surface topology of the interconnect material or insulating film on the substrate after polishing, herein referred to as polishing profile, changes with time in accordance with a degree of wear of the polishing member. In general, a change of the polishing member is set at a time before a change in a polishing profile with time begins to affect device performance.

Semiconductor devices are becoming finer these days, and processing speeds of devices are becoming higher by multi-level lamination of interconnects. With such semiconductor devices, a surface topology of an interconnect metal or an insulating film after polishing, i.e., a polishing profile, is required to be made flat with higher accuracy. Thus, an acceptable change in polishing profile with time is narrower for devices with finer and advanced multi-level interconnects. This necessitates more frequent changes of worn polishing members. However, consumable members for use in CMP are generally very costly, and therefore an increase in a frequency of change of consumable members significantly affects device cost.

A method is known conventionally which comprises measuring a thickness of a film on a wafer before and after polishing in a CMP process and, based on results of this measurement, setting polishing conditions for a next wafer to be polished (see, for example, Published Japanese Translation of PCT international Publication No. 2001-501545). According to this technique, a polishing coefficient, indicating a polishing rate per unit surface pressure, is determined as an average value without a distribution on a wafer based on results of measurement, and such polishing time and polishing pressure for the next wafer are set that will provide a desired average polishing amount. This is because the polishing coefficient changes with condition of polishing (including wear of consumable member, a condition of slurry, temperature, and the like), and therefore it is necessary to update the polishing coefficient, and thus polishing time and polishing pressure as needed, by using the results of measurement. However, techniques for detecting an end point of polishing are fully developed nowadays, and it is now possible to automatically terminate polishing when a desired film thickness has been reached despite a change in a state of polishing. Accordingly, it is not necessary now to employ the above-described technique.

Further, since this conventional technique merely updates the polishing time and polishing pressure so that a desired average polishing amount can be obtained, it is not possible to correct a change in the polishing profile with time due to wear of a polishing member.

Another known technique involves monitoring and calculating a thickness of a remaining film during polishing in a CMP process, and changing each of pressures of pressure chambers so as to enhance flatness of the remaining film, thereby correcting a change in a polishing profile with time due to a change with time in slurry or polishing pad used (see, for example, Japanese Patent Laid-Open Publication No. 2001-60572). This technique is intended to be applied to a wafer polishing process in which a thickness of a film is measured with an optical sensor. A number of measurement points is inevitably limited by a spot size of the optical sensor and a rotational speed of a polishing table. This technique thus has a problem in that sufficient information cannot be obtained for setting chamber pressures that are to be changed to flatten the remaining film after polishing. Further, when this technique is applied to a wafer polishing process employing a high polishing rate, there is a case in which a response time from measurement of thickness of a remaining film until feedback of a corrected value is longer than the time until termination of polishing. Thus, the polishing can be terminated before control achieves flattening of the remaining film.

SUMMARY OF THE INVENTION

The present invention has been made in view of the above situation in the related art. It is therefore an object of the present invention to provide a polishing method which, during a polishing process of flatly polishing a surface of an interconnect material or an insulating film laminated on a substrate in manufacturing of a semiconductor device, can automatically reset polishing conditions according to a state of a polishing member based on data on a polishing profile changing with time, thereby extending life of the polishing member and obtaining flatness of a polished surface with higher accuracy, and to provide an apparatus adapted to perform the polishing method.

In order to achieve the above object, the present invention provides a polishing apparatus comprising a top ring for holding and rotating a polishing object, such as a wafer, and pressing the polishing object against a polishing member to polish the polishing object. The top ring includes a plurality of concentrically-divided pressing portions, and is designed to be capable of independently setting a pressure for each pressing portion, whereby a pressure between the polishing object and the polishing member can be controlled. When a polishing profile of a polishing object is not flat, it is possible, for example, to apply such an additional pressure to a portion deficient in polishing amount as to compensate for this deficient amount, thus providing a flat polished surface with high accuracy.

The pressure of each processing portion of the top ring is generally set so that the polished surface of an interconnect metal or an interlevel insulating film formed on a polishing object becomes flat. This pressure setting, in many cases, has conventionally been practiced according to an engineer's empirical rule. With such an empirical rule, it is usually necessary to previously polish several polishing objects for adjustment in order to establish conditions for a planarized surface of the polishing object.

The present invention employs a first simulation software which estimates and calculates a polishing profile of a polishing object through input of pressure setting conditions for each pressing portion of the above-described top ring. It has been found that results of simulation with the first simulation software only produce a 1–5% error with respect to an actual polishing profile. The present invention can avoid waste of polishing objects, which is necessary for adjustment of pressure setting in the conventional method, and can estimate a polishing profile in a very short time by using the simulation software, thus shortening time for adjustment of pressure setting.

According to the first simulation software, by merely updating a polishing coefficient (coefficient involving an influence of a polishing pad, slurry, and the like) which can be determined from results of measurement of a thickness of a remaining film (or polishing profile) at a relatively small number of measurement points, it is possible to estimate the thickness of the remaining film after polishing at its numerous points other than the measurement points. This makes it possible to easily correct influence of changes in a slurry and a polishing member, such as a polishing pad, and to estimate the polishing profile to be obtained under corrected reset polishing conditions. In a case where updating of a polishing coefficient is made by using results of polishing performed under polishing conditions close to the polishing conditions set in the first simulation software, the error can be made as low as about 1 to 3%. In a practical semiconductor device manufacturing line in which polishing objects (wafers) are polished successively, there is no significant difference in the set values of polishing conditions between successive polishing objects, thereby enabling a high-accuracy simulation. When the number of measurement points for measurement of a polishing profile is relatively small, it is desirable to utilize a curve interpolating these measured values to determine a polishing coefficient.

The present invention obtains a desired polishing profile by making a remaining film on a wafer into one having a desired thickness. For this purpose, according to the present invention, desired set pressures of respective pressing portions of the top ring are calculated with a second simulation software by inputting desired polishing time, average polishing amount and configuration of remaining film (or polishing profile) so as to satisfy these conditions. The second simulation software incorporates the first simulation software as a module. An estimated polishing profile at a set pressure is calculated with the first simulation software and this estimated profile is compared with a desired polishing profile. Based on this comparison, a corrected set pressure is calculated. By repeating calculation of estimated polishing profile and the calculation of corrected set pressure with the second simulation software, it is possible to calculate a desired set pressure that provides a polishing profile approximating the desired polishing profile.

In practice, a set polishing time may be used as a reference value (target value), and polishing may be terminated when an actual amount of a remaining film being monitored has reached a desired value (end point detection manner).

Unlike the conventional technique that stabilizes an average polishing amount, the present invention can also control and stabilize surface flatness after polishing or a thickness of remaining film. For this purpose, according to the present invention, after processing preferably one test polishing object and updating the polishing coefficient, optimized polishing conditions for providing desired polishing time, average polishing amount and thickness of remaining film, are obtained using the second simulation software. A polishing object is polished under the optimized polishing conditions. The polishing coefficient is updated as needed according to wear of a polishing member, and polishing conditions are re-optimized to stably provide a desired polishing time, average polishing amount and configuration of remaining film.

By feeding back the polishing conditions of a polished polishing object in performing polishing, it becomes possible to ensure quality of a polished polishing object with higher accuracy, taking account of accuracy of flatness of a remaining film after polishing and accuracy of feedback control which is influenced by the polishing conditions. When a failure occurs in the polishing apparatus, or a polishing member (consumable member) wears out and reaches its use limit, a desired polishing profile may not be obtained even if the polishing conditions are adjusted. In such cases, according to the present invention, operation of the polishing apparatus can be stopped or a warning can be issued based on the polishing conditions calculated with the second simulation software. This can increase product yield and extend life of a polishing member to its use limit.

It is possible with the present invention to obtain data of polishing profile not only for a film measurable with an optical measuring device, but also for a metal film by using a metal film-measurable device and perform feedback control. The present invention is thus highly versatile with no limitation on its application to polishing processes. Furthermore, data on film thickness can be obtained by any suitable method, such as a method of measuring a film thickness with a measuring device capable of monitoring this thickness during polishing, a method of transporting a wafer to a measuring device for measurement after polishing, or a method of measuring a film thickness outside the polishing apparatus and transferring and inputting film thickness data to the polishing apparatus. It is also possible to employ a combination of these methods. For example, data on film thickness before and after polishing may be obtained by different methods to facilitate operation.

In addition, by reading a program for executing the simulation tool of the present invention from a computer-readable storage medium into a computer for controlling the polishing apparatus, it becomes possible to expand a function of a conventional polishing apparatus.

DETAILED DESCRIPTION OF THE PREFERRED EMBODIMENTS

A polishing method and a polishing apparatus (CMP apparatus) according to embodiments of the present invention will be described below with reference to drawings. First, a polishing apparatus according to an embodiment of the present invention will be described using FIG. 1 which is a plan view showing an entire arrangement of a polishing apparatus, and FIG. 2 which is a perspective view of the polishing apparatus.

Figure 1:
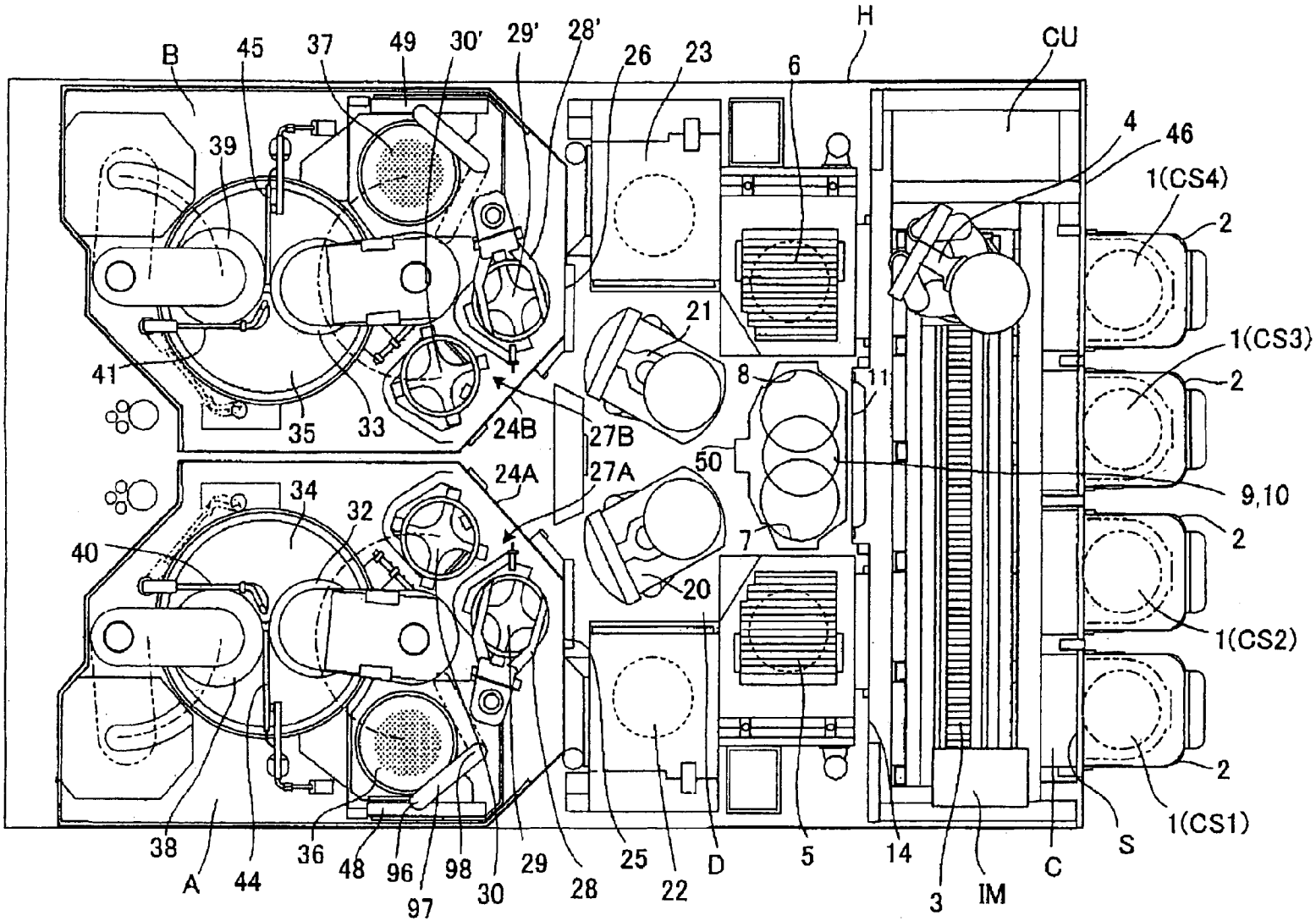
FIG. 1 is a plan view schematically showing a polishing apparatus according to an embodiment of the present invention.
Figure 2:
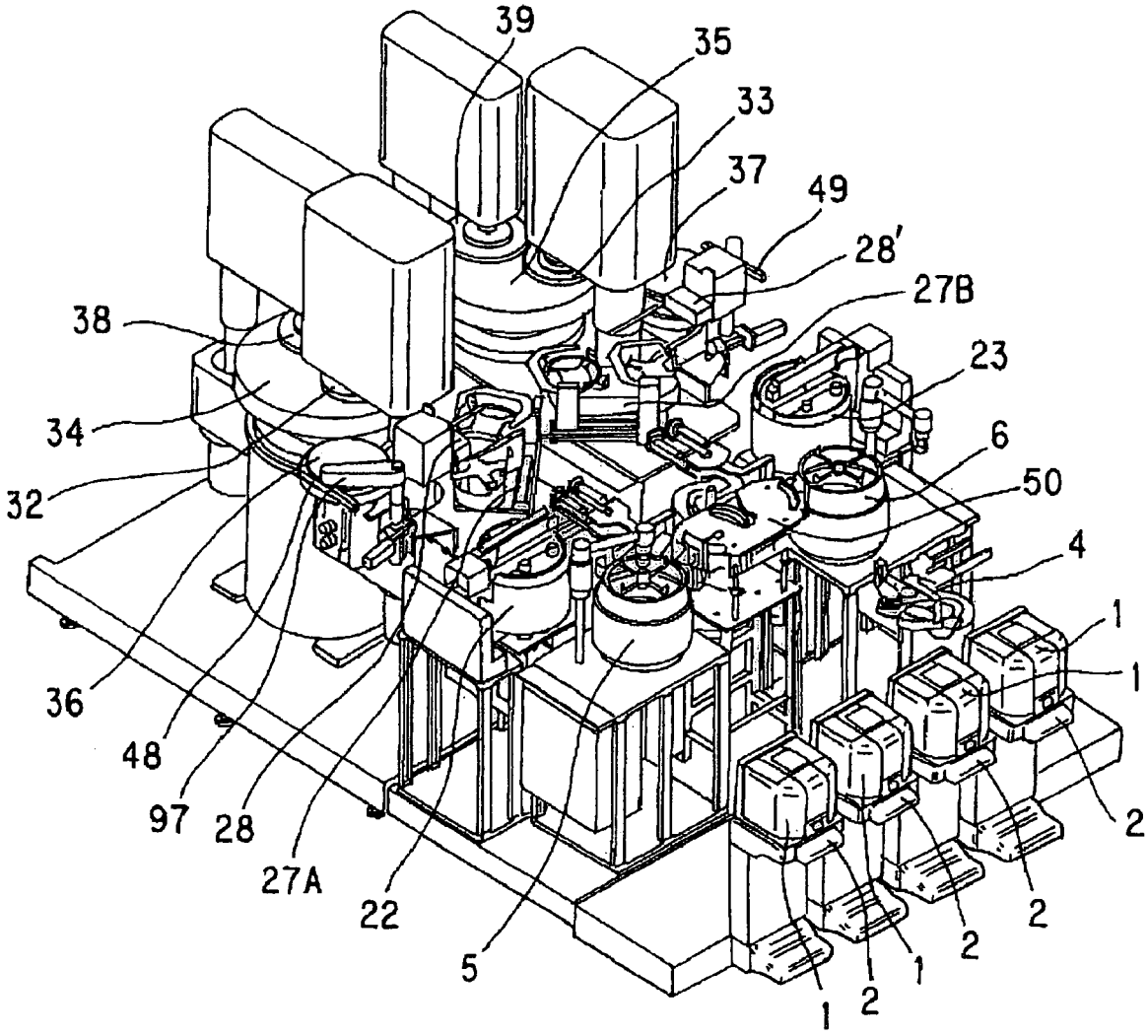
FIG. 2 is a perspective view of the polishing apparatus of FIG. 1.

As shown in FIGS. 1 and 2, two polishing portions are provided in areas A, B. Each of the polishing portions comprises two stages linearly movable in a reciprocating fashion as a dedicated transport mechanism for each of the polishing portions. Specifically, a polishing apparatus shown in FIGS. 1 and 2 comprises four load-unload stages 2 each for placing a wafer cassette 1 that accommodates a plurality of semiconductor wafers. A transfer robot 4 having two hands is provided on a travel mechanism 3 so that the transfer robot 4 can move along the travel mechanism 3 and access respective wafer cassettes 1 on respective load-unload stages 2. The travel mechanism 3 employs a linear motor system. Use of a linear motor system enables a stable high-speed transfer of a wafer even when the wafer has large size and weight.

According to the polishing apparatus shown in FIG. 1, an external SMIF (Standard Manufacturing Interface) pod or FOUP (Front Opening Unified Pod) is used as load-unload stage 2 for mounting wafer cassette 1. The SMIF and FOUP are closed vessels each of which can house the wafer cassette therein and, by covering with a partition, can maintain an internal environment independent of an external space. When the SMIF or FOUP is set as the load-unload stage 2 of the polishing apparatus, a shutter S on the polishing apparatus side, provided in a housing H, and a shutter on the SMIF or FOUP side are opened, whereby the polishing apparatus and the wafer cassette 1 become integrated.

After completion of a wafer polishing process, the shutters are closed to separate the SMIF or FOUP from the polishing apparatus, and the SMIF or FOUP is transferred automatically or manually to another processing process. It is therefore necessary to keep an internal atmosphere of the SMIF or FOUP clean. For that purpose, there is a down flow of clean air through a chemical filter in an upper space of an area C, which a wafer passes through right before returning to the wafer cassette 1. Further, since a linear motor is employed for traveling of the transfer robot 4, scattering of dust can be reduced and atmosphere in area C can be kept clean. In order to keep a wafer in the wafer cassette 1 clean, it is possible to use a clean box that may be a closed vessel, such as a SMIF or FOUP, having a built-in chemical filter and a fan, and can maintain its cleanliness by itself.

Two cleaning apparatuses 5, 6 are disposed at an opposite side of the wafer cassettes 1 with respect to the travel mechanism 3 of the transfer robot 4. The cleaning apparatuses 5, 6 are disposed at positions that can be accessed by the hands of the transfer robot 4. Between the two cleaning apparatuses 5, 6 and at a position that can be accessed by the transfer robot 4, there is provided a wafer station 50 having four wafer supports 7, 8, 9 and 10.

An area D, in which the cleaning apparatuses 5, 6 and the wafer station 50 having the wafer supports 7, 8, 9 and 10 are disposed, and area C, in which the wafer cassettes 1 and the transfer robot 4 are disposed, are partitioned by a partition wall 14 so that cleanliness of area D and area C can be separated. The partition wall 14 has an opening for allowing semiconductor wafers to pass therethrough, and a shutter 11 is provided at the opening of the partition wall 14. A transfer robot 20 is disposed at a position where the transfer robot 20 can access the cleaning apparatus 5 and the three wafer supports 7, 9 and 10, and a transfer robot 21 is disposed at a position where the transfer robot 21 can access the cleaning apparatus 6 and the three wafer supports 8, 9 and 10.

A cleaning apparatus 22 is disposed at a position adjacent to cleaning apparatus 5 and accessible by hands of the transfer robot 20, and another cleaning apparatus 23 is disposed at a position adjacent the cleaning apparatus 6 and accessible by hands of the transfer robot 21. Each of the cleaning apparatuses 22, 23 is capable of cleaning both surfaces of a semiconductor wafer. All the cleaning apparatuses 5, 6, 22 and 23, the wafer supports 7, 8, 9 and 10 of the wafer station 50, and the transfer robots 20, 21 are placed in area D. Pressure in area D is adjusted so as to be lower than pressure in area C.

The polishing apparatus shown in FIGS. 1 and 2 has the housing H for enclosing various components therein. An interior of the housing H is partitioned into a plurality of compartments or_chambers (including areas C and D) by partition wall 14 and partition walls 24A, 24B. Thus, two areas A and B, constituting two polishing chambers, are divided from area D by the partition walls 24A, 24B. In each of the two areas A, B, there are provided two polishing tables, and a top ring for holding a semiconductor wafer and pressing the semiconductor wafer against the polishing tables for polishing. That is, polishing tables 34, 36 are provided in area A, and polishing tables 35, 37 are provided in area B. Further, top ring 32 is provided in area A, and top ring 33 is provided in area B. An abrasive liquid nozzle 40 for supplying an abrasive liquid to the polishing table 34 in area A, and a mechanical dresser 38 for dressing the polishing table 34, are disposed in area A. An abrasive liquid nozzle 41 for supplying an abrasive liquid to the polishing table 35 in area B, and a mechanical dresser 39 for dressing the polishing table 35, are disposed in area B. A dresser 48 for dressing the polishing table 36 in area A is disposed in area A, and a dresser 49 for dressing the polishing table 37 in area B is disposed in area B.

The polishing tables 34, 35 include, besides the mechanical dressers 38, 39, atomizers 44, 45 as fluid-pressure dressers. An atomizer is designed to jet a mixed fluid of a liquid (e.g. pure water) and a gas (e.g. nitrogen) in the form of a mist from a plurality of nozzles to a polishing surface. A main purpose of the atomizer is to rinse away polished scrapings and slurry particles deposited on and clogging the polishing surface. Cleaning of the polishing surface by fluid pressure of the atomizer and setting of the polishing surface by mechanical contact of a dresser can effect a more desirable dressing, i.e. regeneration of a polishing surface.

Figure 3:
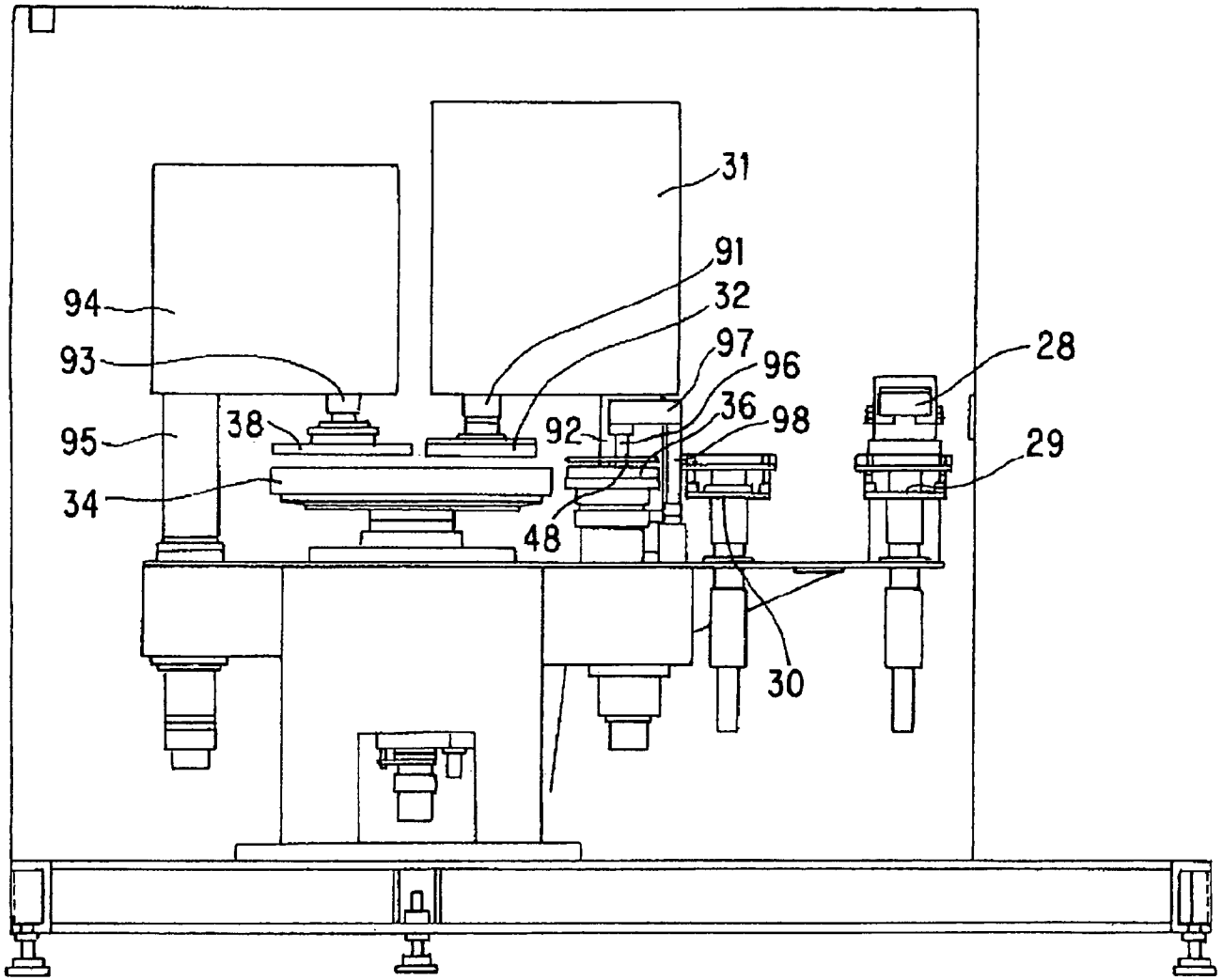
FIG. 3 is a diagram showing a relationship between a top ring and a polishing table of the polishing apparatus of FIG. 1.

FIG. 3 shows a relationship between the top ring 32 and the polishing tables 34, 36. A relationship between the top ring 33 and the polishing tables 35, 37 is the same as that of the top ring 32 and the polishing tables 34, 36. As shown in FIG. 3, the top ring 32 is supported from a top ring head 31 by a top ring drive shaft 91 that is rotatable. The top ring head 31 is supported by a swing shaft 92 which can be angularly positioned, and the top ring 32 can access the polishing tables 34, 36. The dresser 38 is supported from a dresser head 94 by a dresser drive shaft 93 that is rotatable.

The dresser head 94 is supported by an angularly positionable swing shaft 95 for moving the dresser 38 between a standby position and a dressing position over the polishing table 34. A dresser head (swing arm) 97 is supported by an angularly positionable swing shaft 98 for moving the dresser 48 between a standby position and a dressing position over the polishing table 36.

The dresser 48 has a rectangular body longer than a diameter of the polishing table 36. The dresser head 97 is swingable about the swing shaft 98. A dresser fixing mechanism 96 is provided at a free end of the dresser head 97 to support the dresser 48. The dresser fixing mechanism 96 and the dresser 48 make a pivot motion to cause the dresser 48 to move like a wiper, for wiping a windowshield of a car, on the polishing table 36 without rotating the dresser 48 about its own axis. The polishing tables 36, 37 may comprise a scroll-type table.

Returning to FIG. 1, in area A separated from area D by the partition wall 24A and at a position that can be accessed by the hands of the transfer robot 20, there is provided a reversing device 28 for reversing a semiconductor wafer. In area B separated from area D by the partition wall 24B and at a position that can be accessed by the hands of the transfer robot 21, there is provided a reversing device 28' for reversing a semiconductor wafer. The partition walls 24A, 24B between area D and areas A, B has two openings each for allowing semiconductor wafers to pass therethrough. Shutters 25, 26 are provided at respective openings only for reversing devices 28, 28'.

The reversing devices 28, 28' have a chuck mechanism for chucking a semiconductor wafer, a reversing mechanism for reversing a semiconductor wafer, and a semiconductor wafer detecting sensor for detecting whether or not the chuck mechanism chucks a semiconductor wafer, respectively. The transfer robot 20 transfers a semiconductor wafer to the reversing device 28, and the transfer robot 21 transfers a semiconductor wafer to the reversing device 28'.

In area A constituting one of the polishing chambers, there is provided a linear transporter 27A constituting a transport mechanism for transporting a semiconductor wafer between the reversing device 28 and the top ring 32. In area B constituting the other of the polishing chambers, there is provided a linear transporter 27B constituting a transport mechanism for transporting a semiconductor wafer between the reversing device 28' and the top ring 33. Each of the linear transporters 27A, 27B comprises two stages linearly movable in a reciprocating fashion. Each semiconductor wafer is transferred between the linear transporter and the top ring or the linear transporter and the reversing device via a wafer tray.

On the right side of FIG. 3, a relationship between the linear transporter 27A, a lifter 29 and a pusher 30 is shown. A relationship between the linear transporter 27B, a lifter 29' and a pusher 30' is the same as that shown in FIG. 3. In the following description, the linear transporter 27A, the lifter 29 and the pusher 30 are used for explanation. As shown in FIG. 3, the lifter 29 and the pusher 30 are disposed below the linear transporter 27A, and the reversing device 28 is disposed above the linear transporter 27A. The top ring 32 is angularly movable so as to be positioned above the pusher 30 and the linear transporter 27A.

Figure 4:
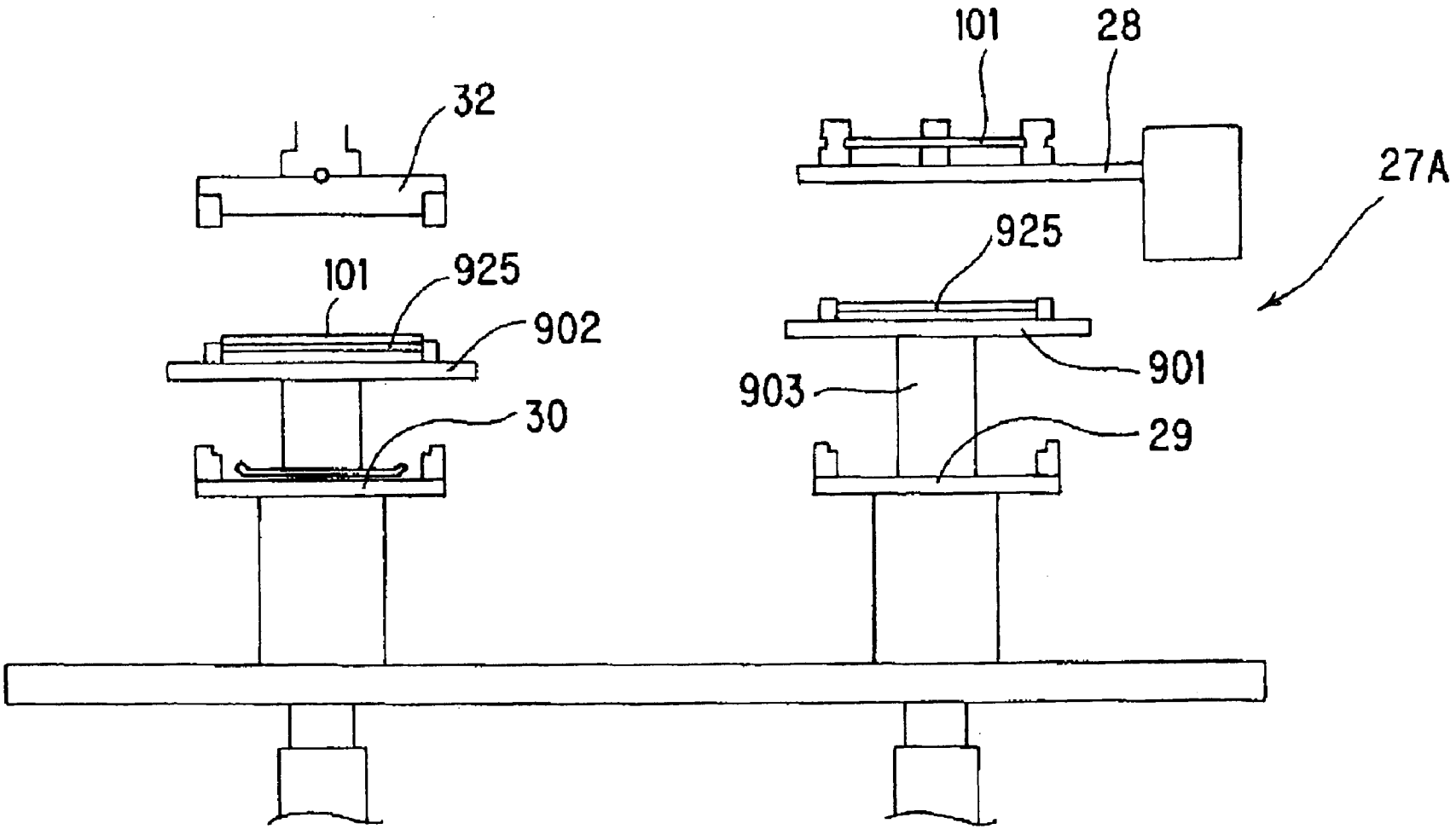
FIG. 4 is a diagram illustrating transfer of a semiconductor wafer between a linear transporter and a reversing machine and between the linear transporter and the top ring of the polishing apparatus of FIG. 1.

FIG. 4 is a schematic view showing a transfer operation of a semiconductor wafer between the linear transporter and the reversing device, and between the linear transporter and the top ring. As shown in FIG. 4, a semiconductor wafer 101, to be polished, which has been transported to the reversing device 28, is reversed by the reversing device 28. When the lifter 29 is raised, wafer tray 925 on stage 901 for loading in the linear transporter 27A is transferred to the lifter 29. The lifter 29 is further raised, and the semiconductor wafer 101 is transferred from the reversing device 28 to the wafer tray 925 on the lifter 29. Then, the lifter 29 is lowered, and the semiconductor wafer 101 is transferred together with the wafer tray 925 to the stage 901 for loading in the linear transporter 27A. The semiconductor wafer 101 and the wafer tray 925 placed on the stage 901 are transported to a position above the pusher 30 by linear movement of the stage 901. At this time, stage 902 for unloading in the linear transporter 27A receives a polished semiconductor wafer 101 from the top ring 32 via the wafer tray 925, and then is moved toward a position above the lifter 29. The stage 901 for loading and the stage 902 for unloading pass each other. When the stage 901 for loading reaches a position above the pusher 30, the top ring 32 is positioned at a location shown in FIG. 4 beforehand by a swing motion thereof. Next, the pusher 30 is raised, and receives the wafer tray 925 and the semiconductor wafer 101 from the stage 901 for loading. Then, the pusher 30 is further raised, and only the semiconductor wafer 101 is transferred to the top ring 32.

The semiconductor wafer 101 transferred to the top ring 32 is held under vacuum by a vacuum attraction mechanism of the top ring 32, and transported to the polishing table 34. Thereafter, the semiconductor wafer 101 is polished by a polishing surface composed of a polishing pad or a grinding stone or the like attached on the polishing table 34. First polishing table 34 and second polishing table 36 are disposed at positions that can be accessed by the top ring 32. With this arrangement, a primary polishing of a semiconductor wafer can be conducted by the first polishing table 34, and then a secondary polishing of the semiconductor wafer can be conducted by the second polishing table 36. Alternatively, the primary polishing of the semiconductor wafer can be conducted by the second polishing table 36, and then the secondary polishing of the semiconductor wafer can be conducted by the first polishing table 34.

The semiconductor wafer 101, which has been polished, is returned to the reversing device 28 in a reverse route relative to the above. The semiconductor wafer 101 returned to the reversing device 28 is rinsed by pure water or chemicals for cleaning supplied from rinsing nozzles. Further, a wafer holding surface of the top ring 32, from which the semiconductor wafer has been removed, is also cleaned by pure water or chemicals supplied from cleaning nozzles.

Next, processes conducted in the polishing apparatus shown in FIGS. 1 through 4 will be described below. In two cassette parallel processing in which two-stage cleaning is performed, one semiconductor wafer is processed in the following route: the wafer cassette (CS1)→the transfer robot 4→the wafer support 7 of the wafer station 50→the transfer robot 20→the reversing device 28→the wafer stage 901 for loading in the linear transporter 27A→the top ring 32→the polishing table 34→the top ring 36 (as necessary)→the wafer stage 902 for unloading in the linear transporter 27A→the reversing device 28→the transfer robot 20→the cleaning apparatus 22→the transfer robot 20→the cleaning apparatus 5→the transfer robot 4→the wafer cassette (CS1).

Another semiconductor wafer is processed in the following route: the wafer cassette (CS2)→the transfer robot 4→the wafer support 8 of the wafer station 50→the transfer robot 21→the reversing device 28'→the wafer stage 901 for loading in the linear transporter 27B→the top ring 33→the polishing table 35→the polishing table 37 (as necessary) →the wafer stage 902 for unloading in the linear transporter 27B→the reversing device 28'→the transfer robot 21→the cleaning apparatus 23→the transfer robot 21→the cleaning apparatus 6→the transfer robot 4→the wafer cassette (CS2).

In two cassette parallel processing in which three-stage cleaning is performed, one semiconductor wafer is processed in the following route: the wafer cassette (CS1)→the transfer robot 4→the wafer support 7 of the wafer station 50→the transfer robot 20→the reversing device 28→the wafer stage 901 for loading in the linear transporter 27A→the top ring 32→the polishing table 34→the polishing table 36 (as necessary)→the wafer stage 902 for unloading in the linear transporter 27A→the reversing device 28→the transfer robot 20→the cleaning apparatus 22→the transfer robot 20→the wafer support 10 of the wafer station 50→the transfer robot 21→the cleaning apparatus 6→the transfer robot 21→the wafer support 9 of the wafer station 50→the transfer robot 20→the cleaning apparatus 5→the transfer robot 4→the wafer cassette (CS1).

Another semiconductor wafer is processed in the following route: the wafer cassette (CS2)→the transfer robot 4→the wafer support 8 of the wafer station 50→the transfer robot 4→the reversing device 28'→the wafer stage 901 for loading in the linear transporter 27B→the top ring 33→the polishing table 35→the polishing table 37 (as necessary)→the wafer stage 902 for unloading in the linear transporter 27B→the reversing device 28'→the transfer robot 21→the cleaning apparatus 23→the transfer robot 21→the cleaning apparatus 6→the transfer robot 21→the wafer support 9 of the wafer station 50→the transfer robot 20→the cleaning apparatus 5→the transfer robot 4→the wafer cassette (CS2).

In serial processing in which three-stage cleaning is performed, a semiconductor wafer is processed in the following route: the wafer cassette (CS1)→the transfer robot 4→the wafer support 7 of the wafer station 50→the transfer robot 20→the reversing device 28→the wafer stage 901 for loading in the linear transporter 27A→the top ring 32→the polishing table 34→the polishing table 36 (as necessary)→the wafer stage 902 for unloading in the linear transporter 27A→the reversing device 28→the transfer robot 20→the cleaning apparatus 22→the transfer robot 20→the wafer support 10 of the wafer station 50→the transfer robot 21→the reversing device 28'→the wafer stage 901 for loading in the linear transporter 27B→the top ring 33→the polishing table 35→the polishing table 37 (as necessary)→the wafer stage 902 for unloading in the linear transporter 27B→the reversing device 28'→the transfer robot 21→the cleaning apparatus 23→the transfer robot 21→the cleaning apparatus 6→the transfer robot 21→the wafer support 9 of the wafer station 50→the transfer robot 20→the cleaning apparatus 5→the transfer robot 4→the wafer cassette (CS1).

According to the polishing apparatus shown in FIGS. 1 through 4, since a linear transporter having at least two stages, which are linearly moved in a reciprocating fashion, is provided as a dedicated transport mechanism for each of the polishing portions, it is possible to shorten a time required to transfer a polishing object, such as a semiconductor wafer, between the reversing device and the top ring, for thereby greatly increasing a number of processed polishing objects per unit time, i.e., throughput. Further, when a polishing object is transferred between a stage of the linear transporter and the reversing device, the polishing object is transferred between the wafer tray and the reversing device, and when the polishing object is transferred between a stage of the linear transporter and the top ring, the polishing object is transferred between the wafer tray and the top ring. Therefore, the wafer tray can absorb an impact or a shock on the polishing object generated when transferring, and hence a transfer speed of the polishing object can be increased for thereby increasing throughput. Furthermore, transfer of the polishing object from the reversing device to the top ring can be performed by the wafer tray removably held by respective stages of the linear transporter. Thus, for example, transfer of the polishing object between the lifter and the linear transporter or between the linear transporter and the pusher may be eliminated to prevent dust from being generated and prevent the polishing object from being damaged due to transfer error or clamping error.

A plurality of wafer trays are assigned to each loading wafer tray for holding a polishing object to be polished and each unloading wafer tray for holding a polishing object which has been polished. Therefore, a polishing object to be polished is transferred not from the pusher but from the loading wafer tray to the top ring, and a polished polishing object is transferred from the top ring not to the pusher but to the unloading wafer tray. Thus, loading of the polishing object to the top ring, and unloading of the polishing object from the top ring are conducted by respective jigs (or components), i.e. the wafer tray, and hence abrasive liquid or the like attached to the polished polishing object is prevented from being attached to a common support member for performing loading and unloading of the polishing object. As a result, solidified abrasive liquid or the like is not attached to the polishing object to be polished, and does not cause damage to the polishing object to be polished.

An inline monitor IM is provided in an appropriate place in area C of the above-described polishing apparatus. A wafer after polishing and cleaning is transferred to the inline monitor IM by the transfer robot 4, where a film thickness or a polishing profile of the wafer is measured. The inline monitor IM is actually disposed above the transfer robot 4. Motion of the polishing apparatus in its entirety is controlled by a control unit CU. The control unit CU is provided with a connector to be connected to a storage medium reader for reading a control program and data from an external storage medium by connecting the storage medium reader to the control unit CU as necessary. The control unit CU may be provided in the polishing apparatus, as shown in FIG. 1. Alternatively, the control unit CU may be separated from the polishing apparatus. The inline monitor IM and the control unit CU are omitted in FIG. 2.

As is known from Preston's equation, a polishing amount of a wafer is approximately proportional to pressure of a surface of the wafer on a polishing pad. In order to determine the pressure, however, it is necessary to perform modeling of a top ring having a complicated structure and take account of non-linearity of a polishing pad which is an elastic material, a large deformation of a wafer which is a thin plate, and a stress concentration which is especially marked at an edge of a wafer. It is therefore difficult to obtain an analytical solution of a distribution of the pressure of the surface of the wafer mathematically. On the other hand, use of a finite element method or a boundary element method for determining the pressure involves dividing these objects into a large number of elements, leading to a vast amount of calculation. This necessitates much computation time and a high computational capacity. Moreover, to obtain appropriate results, it is necessary for an operator to have expert knowledge of numerical analysis. It is therefore virtually impossible from a practical viewpoint, and also in view of cost to use such a numerical analysis method as a reference in performing a simple adjustment in a work site or to use this method by incorporating it into a polishing apparatus.

In a case where a profile control-type top ring is employed in the polishing apparatus of the above-described construction, this problem becomes more complex. The "profile control-type top ring" is a generic term for top rings having a plurality of pressing portions. Examples of such top rings include a top ring having a plurality of pressing portions comprised of air bags or water bags partitioned concentrically with membranes, a top ring having a plurality of pressing portions, comprised of partitioned air chambers, for directly pressing on a back surface of a wafer with air pressure by independently pressurizing respective air chambers, a top ring having pressing portions that press on a wafer by springs, and a top ring having localized pressing portions including one or more piezoelectric devices. A top ring having a combination of such pressing portions can also be used. As interactions of these pressing portions are added to the above problem, it is not easy to determine the pressure of the surface of the wafer. Then, according to the present invention, a distribution of the pressure of the surface of the wafer is determined using a first simulation as described below. The following description illustrates a top ring having a plurality of concentrically-partitioned air bags as pressing portions.

Figure 5:
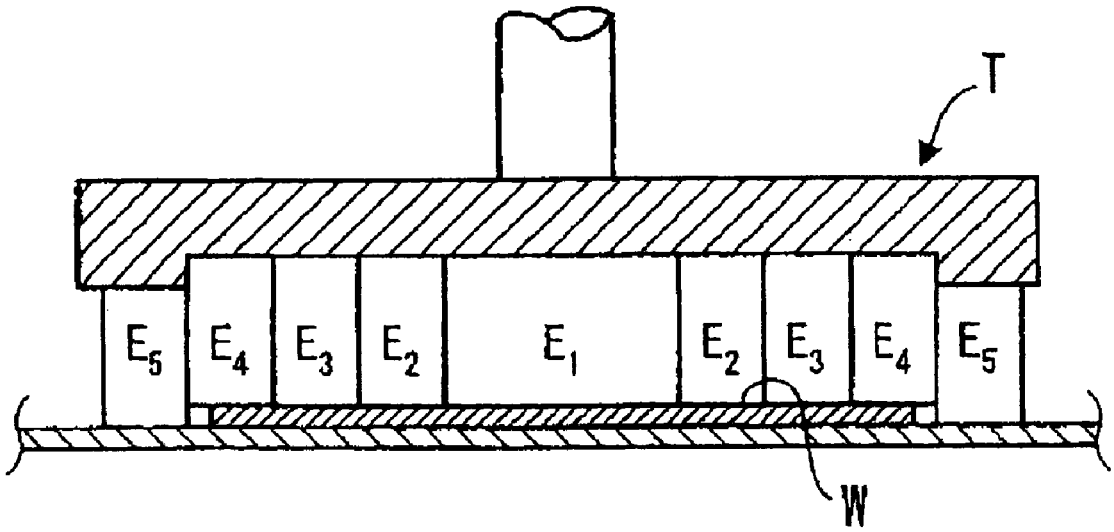
FIG. 5 is a cross-sectional diagram showing a construction of the top ring used in the polishing apparatus of FIG. 1.

Thus, as shown in FIG. 5, top ring T includes a plurality of concentric air bags, in which a pressure applied in each air bag onto a corresponding area of a wafer is adjusted by a resultant value of a novel method. In the following description, an air bag side of a wafer is referred to as wafer back surface and a polishing pad side as wafer front surface. FIG. 5 is a cross-sectional view of the top ring T for use in the polishing apparatus shown in FIG. 1, showing a cross-section including a top ring drive shaft. The top ring T has a central disk-shaped air bag E1, a doughnut-shaped air bag E2 surrounding the air bag E1, a doughnut-shaped air bag E3 surrounding the air bag E2, a doughnut-shaped air bag E4 surrounding the air bag E3, and a doughnut-shaped retainer ring E5 surrounding the air bag E4. As shown in FIG. 5, the retainer ring E5 is configured to contact a polishing pad, and a wafer W placed on a polishing table is housed in a space surrounded by the retainer ring E5 and pressurized by the air bags E1 to E4 independently.

A number of the air bags of the top ring T is not limited to 4, but may be increased or decreased according to a size of the wafer. Though not shown in FIG. 5, air pressure supply devices for adjusting pressures of the air bags E1 to E4 on the back surface of the wafer W are provided each for each air bag, in appropriate places in the top ring T. Pressure on the retainer ring E5 may be controlled by providing an air bag on the retainer ring E5 and adjusting a pressure of this air bag in the same manner as the air bags E1 to E4, or by adjusting a pressure transmitted directly from the shaft supporting the top ring T.

According to the present invention, a set of a distribution of the pressure of the front surface of the wafer W corresponding to a combination of pressures applied by the air bags E1 to E4 and the retainer ring E5 to the back surface of the wafer W and to a surface of the polishing pad a round the wafer W, is calculated and stored in advance in a memory of the above-described control unit CU of the polishing apparatus. Assuming that the distribution of the pressure of the front surface of the wafer W can be regarded as substantially linear (i.e. a superposition principle substantially holds true) if, during a polishing process, a practical pressure setting range for the pressures of the air bags on the back surface of the wafer and for the pressure of the retainer ring on the polishing pad are 100 to 500 hPa and the air pressure is within the range of ±200 hPa, the distribution of the pressure of the front surface of the wafer W, corresponding to any of intended pressures of the air bags on corresponding areas of the back surface of the wafer, can be determined within a back surface pressure setting range of ±200 hPa by synthesizing the distribution of the pressure of the front surface of the wafer, corresponding to a combinations of three back surface pressures, 100 hPa, 300 hPa and 500 hPa.

A description will now be given of a method of synthesizing the pressure of the front surface of a wafer W from pressures applied from the air bags E1 to E4 onto the wafer W, and from the retainer ring E5 on a polishing pad (hereinafter referred to as back surface pressures), in a case where the top ring T is designed to be capable of controlling these five pressures, i.e. the pressures of the four air bags E1 to E4 on the wafer W and the pressure of the retainer ring E5 on the surface (polishing surface) of the polishing pad around the wafer W, by referring to FIG. 6.

First, data on a distribution of the pressure of the wafer front surface on a polishing member (polishing pad) is obtained and stored in advance. In a case of the above-described five regions and three pressures, a number of combinations of the back surface pressures is total $3^5$=243. Of these combinations, 27 combinations are selected as necessary combinations for synthesizing the distribution of the pressure of the wafer front surface. Assuming that pressures $Z_1$, $Z_2$, $Z_3$, $Z_4$ and $Z_5$ (unit: hPa), respectively denoting the pressures of the air bags E1 to E4 on the wafer and the pressure of the retainer ring E5 on the surface of the polishing pad around the wafer, can each take either one of the values 100, 300 and 500, the 27 combinations of the Z1–Z5 values, which are to be stored in a memory of the control unit CU, are as follows:

(1) Z1–Z5=100
(2) Z1–Z5=300
(3) Z1–Z5=500
(4) Z1=100, Z2–Z5=300
(5) Z1=100, Z2–Z5=500
(6) Z1=300, Z2–Z5=100
(7) Z1=300, Z2–Z5=500
(8) Z1=500, Z2–Z5=100
(9) Z1=500, Z2–Z5=300
(10) Z1=Z2=100, Z3–Z5=300
(11) Z1=Z2=100, Z3–Z5=500 . . .
(27) Z1=Z2=Z3=Z4=500, Z5=300

The distributions of the pressure of the front surface of the wafer, corresponding to the above 27 combinations of the set pressures on the wafer back surface, can be calculated in advance using, for example, a finite element method. This calculated distribution of the pressure of the front surface of the wafer and the 27 combinations of back surface pressures correspond to the calculated pressures, and are stored in a memory of the control unit CU. The combinations of the set pressures and the corresponding distributions of the pressure of the wafer front surface may be stored in the memory of the control unit CU by reading this information from a storage medium with a storage medium reader connected to the control unit CU, or by storing the information in advance in a ROM set in the control unit CU and reading the information from the ROM.

Various distributions of the pressure of the wafer front surface corresponding to various changes in the wafer back surface pressures are then synthesized by using the 27 combinations stored in the memory. To give a specific example, in a case of applying the following pressures: 150 hPa by the air bag E1; 200 hPa by the air bag E2; 150 hPa by each of the air bags E3 and E4; and 250 hPa by the retainer ring E5, i.e., in a case where the set pressures to be calculated are: Z1=150, Z2=200, Z3=Z4=150 and Z5=250, intended set pressures can be expressed in vector form: $Zp=[150\ 200\ 150\ 150\ 250]^T$, wherein the symbol T represents transpose of matrix. Thus, similarly, the above 27 combinations of pressures can also be exposed by vector form. For example, the combination of pressures of the above item (4) can be expressed by vector $Z_{c2}=[100\ 300\ 300\ 300\ 300]^T$. The suffix (e.g. C2) is a serial number indicative of conditions.

In determining the distribution of the pressure of the wafer front surface, corresponding to an intended set pressure vector Zp, 5 combinations are selected from the above 27 combinations of the back surface pressures applied by the air bags so as to respond to changes in the set pressures of adjacent areas. For example, the following 5 combinations expressed by vectors are selected in order to realize the above-described set pressure application conditions of Z1=150, Z2=200, Z3=Z4=150 and Z5=250:

$$Z_{c1}=[100\ 100\ 100\ 100\ 100]^T$$

$$Z_{c2}=[100\ 300\ 300\ 300\ 300]^T$$

$$Z_{c3}=[300\ 300\ 100\ 100\ 100]^T$$

$$Z_{c5}=[100\ 100\ 100\ 100\ 100]^T$$

$$Z_{c5}=[100\ 100\ 100\ 100\ 300]^T$$

Using these vectors, the set pressure vector Zp can be expressed as follows:

$$Zp=f1\times Z_{c1}+f2\times Z_{c2}+f3\times Z_{c3}+f4\times Z_{c4}+f5\times Z_{c5}Zp=f150\ 200\ 150\ 150\ 250]^T \quad (1)$$

In equation (1), f1 to f5 are constants. The following 5 equations with f1 to f5 unknown can be obtained from the above equation (1):

$$150=f1\cdot 100+f2\cdot 100+f3\cdot 300+f4\cdot 100+f5\cdot 100$$

$$200=f1\cdot 100+f2\cdot 300+f3\cdot 300+f4\cdot 100+f5\cdot 100$$

$$150=f1\cdot 100+f2\cdot 300+f3\cdot 100+f4\cdot 100+f5\cdot 100$$

$$150=f1\cdot 100+f2\cdot 300+f3\cdot 100+f4\cdot 100+f5\cdot 100$$

$$250=f1\cdot 100+f2\cdot 300+f3\cdot 100+f4\cdot 100+f5\cdot 300$$

From these equations, f1 to f5 can be determined. Since f3 is equal to f4 (f3=f4) in the equations, the number of equations and the number of unknowns are both four.

In other words, when using a matrix with the 5 vectors as its elements, i.e. $Mc=[Z_{c1}\ Z_{c2}\ Z_{c3}\ Z_{c4}\ Z_{c5}]$, a relationship between the intended set pressure vector Zp and coefficient vector $f=[f1\ f2\ f3\ f4\ f5]^T$ can be expressed as follows:

$$Zp=Mc\cdot f \quad (2)$$

Equation (2) indicates that the set pressure vector Zp, to be calculated, can be expressed as a linear combination of the vectors of the combinations of set pressures stored in the memory of the control unit CU. From equation (2), the coefficient vector f can be determined by the following equation:

$$f=Mc^{-1}\cdot Zp$$

There is a case in which the matrix Mc includes a row or column that is not linearly independent, thereby causing inconvenience for determining inverse matrix $Mc^{-1}$. In such a case, the matrix can be converted into an inverse matrix-determinable form by appropriate replacement or addition and subtraction of the row or column. Such arithmetic processing is an ordinary mathematical processing and does not need any special measures to be taken.

After coefficients f1 to f5 are thus determined, pressure distribution Pc of the wafer front surface, corresponding to the intended set pressure Zp, can be obtained by multiplying data on the distributions of the pressure of the wafer front surface ($P_{c1}$ to $P_{c5}$), corresponding to pre-selected combinations of pressures on the wafer back surface (i.e. the five combinations $Z_{c1}$ to $Z_{c5}$), by the respective coefficients f1 to f5 and then adding all these terms together, as follows:

$$Pc=f1\cdot P_{c1}+f2\cdot P_{c2}\ldots$$

In a manner as described above, the distribution of the pressure of the wafer front surface, corresponding to intended set pressures on the wafer back surface, can be determined, without a complicated calculation as by a finite element method, by adopting set pressures on the wafer back surface in such a pressure range that a change in the pressure of the wafer front surface can be regarded as being substantially linear (i.e. the superposition principle holds true), preparing data on pre-calculated distributions of the pressure of the wafer front surface in a number of cases (27 cases in the above example) and appropriately selecting some cases from these and synthesizing this selected data.

The distribution of the pressure of the wafer front surface can thus be determined in accordance with procedures described above. A simulation tool for obtaining the pressure distribution of the wafer front surface, corresponding to the set pressures on the wafer back surface, can be produced by thus storing the procedures in a computer.

It is also possible to determine the coefficient matrix by a method comprising calculating in advance all the combinations of 5 areas and 3 pressures, i.e. $3^5=243$ combinations, formulating the equation $Zp=M_{call}\cdot f_{all}$ using the matrix $M_{call}=[Z_{c1}\ Z_{c2}\ldots Z_{c242}\ Z_{c243}]$ including all the combinations and the coefficient vector $f_{all}=[f1\ f2\ldots f242\ f243]$ representing 243 coefficients, and determining the coefficient vector by $f_{all}=M_{Call}^{-1}\cdot Zp$ using the pseudo inverse matrix of $M_{Call}$. Thus, there is no particular limitation on methods for determining an appropriate coefficient. Since superposition in a pressure range, in which a pressure change can be regarded as being linear, is utilized, any linear algebraic method can be used to determine coefficients corresponding to the coefficients f1 to f5.

A range of pressure on the wafer back surface and particular pressures adopted in the pressure range, which are to be calculated in advance, are not limited to the range of 100 to 500 hPa and the three pressures 100, 300 and 500 hPa described above. For example, the five pressures (100, 200, 300, 400 and 500 hPa) may be adopted only for areas corresponding to the air bag E4 and the retainer ring E5.

After the distribution of the pressure of the wafer front surface is thus determined, an estimated polishing profile of the wafer can be determined by multiplying the pressure distribution and data on the distribution of polishing coefficients on the wafer front surface, previously determined for the wafer to be polished. As is known from Preston's empirical equation, a polishing amount Q of a wafer is approximately proportional to a product of pressure P of the wafer front surface, relative speed v of contact surface and polishing time t:

$$Q=k\cdot P\cdot v\cdot t$$

wherein k is a proportionality constant as determined by material of the polishing pad, material to be polished, a type of slurry used in polishing, and the like.

The relative speed v of contact surface on the wafer front surface (i.e. the relative velocity between the wafer front surface and polishing pad) differs at various points on the wafer front surface, and the polishing time t differs depending on polishing conditions. Taking polishing coefficient as polishing rate per unit pressure, the polishing coefficient corresponds to Kv in Preston's equation. By determining a distribution of Kv values on the wafer front surface in advance, an estimated polishing amount $Q_{est}$ on the wafer front surface can be determined by the following equation:

$$Q_{est}=Kv\cdot Pc$$

Further, an estimated polishing amount per unit time, i.e., estimated polishing rate $Q_{est}\Delta t$ can be determined by the following equation:

$$Q_{est}\Delta t=Q_{est}/t$$

Since an estimated polishing amount (estimated polishing rate) of a wafer can be determined by such a simple calculation, results of a calculation with the simulation tool can be used as a reference in performing a simple adjustment in the work site, or the simulation tool can be incorporated into the polishing apparatus (CMP apparatus). FIG. 6 shows a program flow chart of the simulation tool described hereinabove. The simulation tool can calculate an estimated polishing profile based on set pressures on the wafer back surface and pre-calculated distribution of the pressure of the wafer front surface, and distribution of polishing coefficients. Thus, the simulation tool can perform its function independent of a conventional polishing apparatus, and it becomes possible to add a polishing amount estimation function to a conventional polishing apparatus by simply reading a program for executing the simulation tool from a storage medium reader into a computer installed in the control unit CU and calling up information by use of a panel of the control unit CU or separate software.

Figure 7:
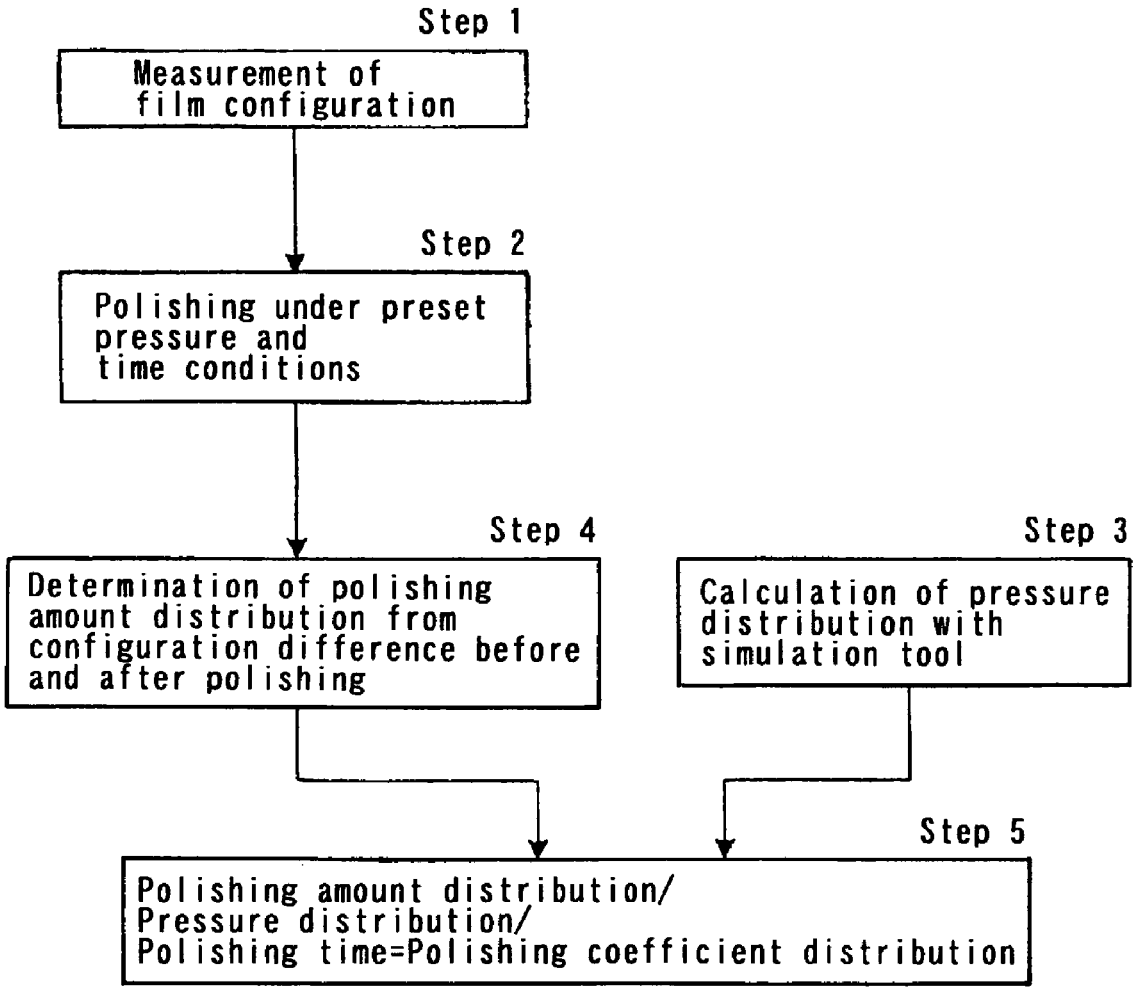
FIG. 7 is a flow chart illustrating a procedure for obtaining data on distribution of polishing coefficients in the polishing apparatus of FIG. 1.

Data on the distribution of polishing coefficients on the wafer front surface can be given in an arbitrary manner. According to a simplest method, a polishing rate can be given as a value which is proportional to a distance r between a center of the wafer and any point on the wafer if a difference Δω in rotating velocity between a polishing pad and the wafer is constant, since the relative speed v is approximately proportional to the distance r and to the difference Δω. FIG. 7 shows a procedure for obtaining data on the distribution of polishing coefficients on the wafer front surface by a method other than the above-described method.

First, in step 1, a surface topology of a film on a wafer is measured in advance. Next, in step 2, the wafer is actually polished under particular set pressure and polishing time conditions. In step 3, a distribution of pressure of the wafer front surface under set pressure conditions is calculated in advance using the simulation tool. A surface topology of the polished film on the wafer is re-measured and, from a difference before and after polishing, a distribution of a polishing amount on the wafer front surface is calculated (step 4). Next, in step 5, this calculated distribution of the polishing amount is divided by the polishing time and the calculated pressure distribution to determine a distribution of polishing rates per unit pressure and unit time at various points on the wafer front surface, i.e. a distribution of polishing coefficients on the wafer front surface. It is also possible to divide the calculated distribution of the polishing amount only by the calculated pressure distribution without division by the polishing time, thus determining a distribution of the polishing rates per unit pressure.

It is also possible to pre-calculate the distribution of polishing coefficients for a polishing pad at a time of its initial use, after its use to a certain degree and near its use limit, and to store data on change in polishing coefficient with time in the control unit CU.

It has been confirmed experimentally that results of estimation of the polishing amount or polishing rate of a wafer by the above-described method for a profile control-type top ring are approximately equal to results of actual polishing of the wafer. In some cases, the polishing profile in a peripheral annular region of a wafer, a region having a width of about 10 mm from a peripheral end, differs slightly from the pressure distribution profile of the wafer front surface. This is because the annular region of the wafer is influenced, during polishing, by a reaction force due to deformation of a polishing pad, which is an elastic body, and by a peripheral bevel portion of the wafer, in addition to influence of pressure applied from the wafer back surface. However, such influences other than the pressure distribution can also be modeled by determining the polishing coefficient from the pressure distribution and the actual polishing profile. This makes it possible to estimate and calculate the polishing profile of the front surface in its entirety of the wafer with high accuracy.

In a case where it has been confirmed that the polishing profile of a peripheral region of the wafer front surface has a particular relationship with a physical factor different from the pressure distribution, it is possible to combine the above-described estimation method with a method for estimating the polishing profile of the peripheral region of the wafer using the particular relationship. Assume, for example, that a difference between the pressure E5$p$ of the retainer ring E5 and the pressure E4$p$ of the air bag E4 located on an outermost peripheral region of the wafer back surface, in association with flow conditions of slurry, affects the polishing coefficient of an outermost 10 mm-width region of the wafer. In this case, it is difficult only with the polishing coefficient calculated from the pressure distribution of the wafer front surface and from particular polishing conditions to estimate with high accuracy the polishing profile with a large change in the pressures E4$p$ and E5$p$. However, in case it has been confirmed that the flow of slurry changes in proportion to a relative change in pressures of E4$p$ and E5$p$, for example, (E4$p$−E5$p$)/|E4$p$|, the polishing coefficient of the outermost region of the wafer can be corrected by multiplying the polishing coefficient by an appropriate correction coefficient which is:

$$1+m\cdot(E4p-E5p)/|E4p|$$

wherein m is an appropriate proportionality constant.

In particular, the appropriate proportionality constant m is determined by comparing a polishing coefficient calculated from results of polishing performed under particular conditions with a polishing coefficient calculated from results of polishing performed by changing only the pressure of the retainer ring E5. The polishing profile of the peripheral region of the wafer is estimated by using the proportionality constant m thus determined. By thus correcting the polishing coefficient using a physical factor not associated with the surface pressure, such as the flow of slurry, temperature distribution, the concentration distribution of slurry, and the like, the polishing profile can be estimated more accurately.

A wafer has, near its peripheral bevel portion, a region which has a relatively poor flatness compared to a wafer central region and whose shape is deviated from an ideal shape. For example, a roll-off can be formed in an outermost region of a wafer having a surface oxide film due to roll-off of a bare wafer. The term "roll-off" herein refers to a shape deviated from an ideal configuration of a wafer edge region. A degree of roll-off can be defined as ROA which is a measured deviation from a reference plane at a point on the wafer front surface e.g. ata 1 mm distance from a peripheral end. The roll-off and ROA of a bare wafer are described in M. Kimura, Y. Saito, et al., A New Method for the Precise Measurement of Wafer Roll Off Silicon Polished Wafer, Jpn. J. Appl. Phys., Vol. 38 (1999), pp. 38–39.

Though the ROA of a bare wafer is at most about 1 μm and the degree of roll-off of an oxide film is also at the same level, the roll-off affects the pressure distribution in the peripheral region with a width of about 5 mm from the peripheral end of the wafer. The ROA differs between wafers and between wafer lots, which causes variation of polishing in the peripheral regions of wafers. An edge shape (usually an ideal edge shape) modeled for a finite element method usually differs from an actual edge shape of a wafer to be polished. A polishing profile can therefore be estimated more accurately by correcting the polishing coefficient of the outermost region with ROA values measured before and during polishing. The polishing coefficient may also be corrected by using an indicator other than ROA, which can indicate a configuration or degree of roll-off.

For measurement of ROA, for example, a contactless measuring method using a laser beam may be employed. Such a method can be performed by using, for example, an edge roll-off measuring device LER-100 manufactured by Kobelco Research Institute, Inc. Further, for measurement of roll-off configuration, a measuring method may be selected from an optical method, a stylus method, an electrical method using, for example, an eddy current sensor, a magnetic method, an electromagnetic method, and a fluidic method, and the like. A roll-off configuration measuring device may either be installed in the polishing apparatus or provided separately from the polishing apparatus. In the case of installing the roll-off configuration measuring device in the polishing apparatus, the roll-off configuring measuring device may be installed adjacent the inline monitor IM shown in FIG. 1, for example, so that a configuration of an edge region of a wafer before polishing can be measured and stored.

In an edge region of a wafer having a surface metal film, the metal film in an outermost region of the wafer is removed, or the metal film is not formed in the outermost region right from the start, for example, for a purpose of preventing contamination. A configuration of an end portion of the metal film is also not flat and thus requires correction of the polishing coefficient. The correction can be made in the same manner as in the case of roll-off of oxide film.

As will be appreciated from the foregoing description, application of the present method is not limited to a profile control-type top ring using air bags. If a force acting on the wafer back surface is found, the pressure distribution of the wafer front surface can be determined and the polishing profile can be estimated therefrom. Thus, the present method can be applied to top rings having various types of pressing portions, including air bags capable of holding a pressurized gas, liquid bags capable of holding a pressurized liquid such as pure water, partitioned air chambers which are directly pressurized with a pressurized gas, pressing portions which generate pressures by elastic bodies, for example, springs, and pressing portions which press by piezoelectric devices, and the like. Top rings having a combination of such various types of pressing portions may also be used.

According to the present invention, the top ring is designed to be capable of setting a polishing pressure independently for each of the plurality of pressing portions, i.e., the air bags E1 to E4 and the retainer ring E5 and, using the above-described simulation tool, pressures that are necessary to set for the respective pressing portions in order to obtain an intended polishing profile are calculated, and these calculated pressure values are fed back to a wafer to be polished later. With this method, even when the polishing profile changes with time due to wear of a polishing member, this change can be corrected as needed. This makes it possible to stably obtain a desired polishing profile. An example of control flow for achieving this will now be described with reference to FIG. 8.

First, a surface topology of a wafer before polishing, i.e., a thickness distribution of an interconnect metal or an insulating film on the wafer, is measured with a film thickness measuring device, such as the inline monitor IM, and this measurement data is stored in a memory (step 1). This measurement is performed on at least one point of the wafer in each of the areas corresponding to the air bags E1 to E4 and an area corresponding to the retainer ring E5. At first, back surface pressures are set arbitrarily for respective areas, and the set back surface pressures are stored in a memory (step 2). The wafer is then polished under polishing conditions including the set pressures (step 3).

Next, a surface topology of the wafer after polishing, i.e. a thickness distribution of the interconnect metal or the insulating film on the wafer is measured with a film thickness measuring device, such as the inline monitor IM, and this measurement data is stored in a memory (step 4). This measurement may be performed with the inline monitor IM installed in the polishing apparatus or with a measuring device installed outside the polishing apparatus. Downloading of the measurement data may be performed either on line or via a storage medium. This measurement is performed on at least one point of the wafer in each of the areas corresponding to the air bags E1 to E4 and the area corresponding to the retainer ring E5.

Based on measurement results, polishing pressure conditions for creating an intended polishing profile are calculated by the following procedure. First, the intended polishing profile is set. This setting may be performed, for example, by designating a plurality of points, at which control of a polishing amount is desired, on the wafer front surface, and setting a polishing amount $Q_T$ or a polishing rate $Q_T\Delta t=Q_T/t$ for each designated point. The following description illustrates a case of setting polishing amount $Q_T$. Thus, a desired polishing amount is inputted and stored in a memory, and a desired polishing amount $Q_T$ corresponding to a measurement point is calculated.

Based on the measurement data stored in the memory in steps 1 and 4, a polishing amount $Q_{Poli}$ is calculated for each of the areas of the wafer after polishing, corresponding to the air bags E1 to E4 and the retainer ring E5 (step 5). This calculated polishing amount $Q_{Poli}$ for each point is divided by polishing pressure P, set before polishing and stored in the memory in step 2, of the area including that point to calculate the polishing amount per unit surface pressure $Q_{Poli}\Delta P=Q_{Poli}/P$ (step 6).

Next, a target polishing amount $Q_T$ at a point nearest to a measurement point is extracted, or a target polishing amount $Q_T$ is approximated linearly from two points near a measurement point. For each point, polishing amount difference $\Delta Q$ between the target polishing amount $Q_T$ and the polishing amount $Q_{poli}$, $\Delta Q=Q_T-Q_{Poli}$, is determined (step 7). The polishing amount corresponding to the polishing amount difference $\Delta Q$ is divided by the polishing amount per unit surface pressure $Q_{Poli}\Delta P$ calculated in step 6 to calculate a correction polishing pressure ΔP of the back surface pressure, $\Delta P=\Delta Q/Q_{Poli}\Delta P$ (step 8).

The correction polishing pressure ΔP calculated in step 8 is added to the pressure P set before polishing in step 2 to determine a recommended polishing pressure value $P_{input}=P+\Delta P$ (step 9). In a case where an area includes a plurality of measurement points, the pressure values calculated for the plurality of points are averaged, and this averaged value is taken as a recommended polishing pressure value $P_{input}$ of the area.

The recommend polishing pressure value $P_{input}$ calculated in step 9 is inputted into the simulation tool of the present invention (step 10), and a polishing amount is calculated for each point in the above-described manner to determine an estimated polishing amount $Q_{est}$. Then, the polishing amount difference ΔQ between the estimated polishing amount $Q_{est}$ and the target polishing amount $Q_T$, $\Delta Q=Q_T-Q_{est}$, is calculated for each point (step 11).

Decision is made as to whether the polishing amount difference ΔQ between the estimated polishing amount $Q_{est}$ and the target polishing amount $Q_T$, calculated for each point in step 11, is within an allowable range (step 12). If the polishing amount difference ΔQ is within the allowable range, the recommended polishing pressure value $P_{input}$ is stored in a memory, and is fed back to step 2 and applied to a wafer to be actually polished (step 13). If the polishing amount difference ΔQ is out of the allowable range, the procedure is returned to step 6 with replacement of $Q_{Poli}=Q_{est}$, $P=P_{input}$, and the procedure from step 6 to step 11 is repeated until the polishing amount difference ΔQ becomes within the allowable range to determine the recommended polishing pressure value $P_{input}$.

Figure 6:
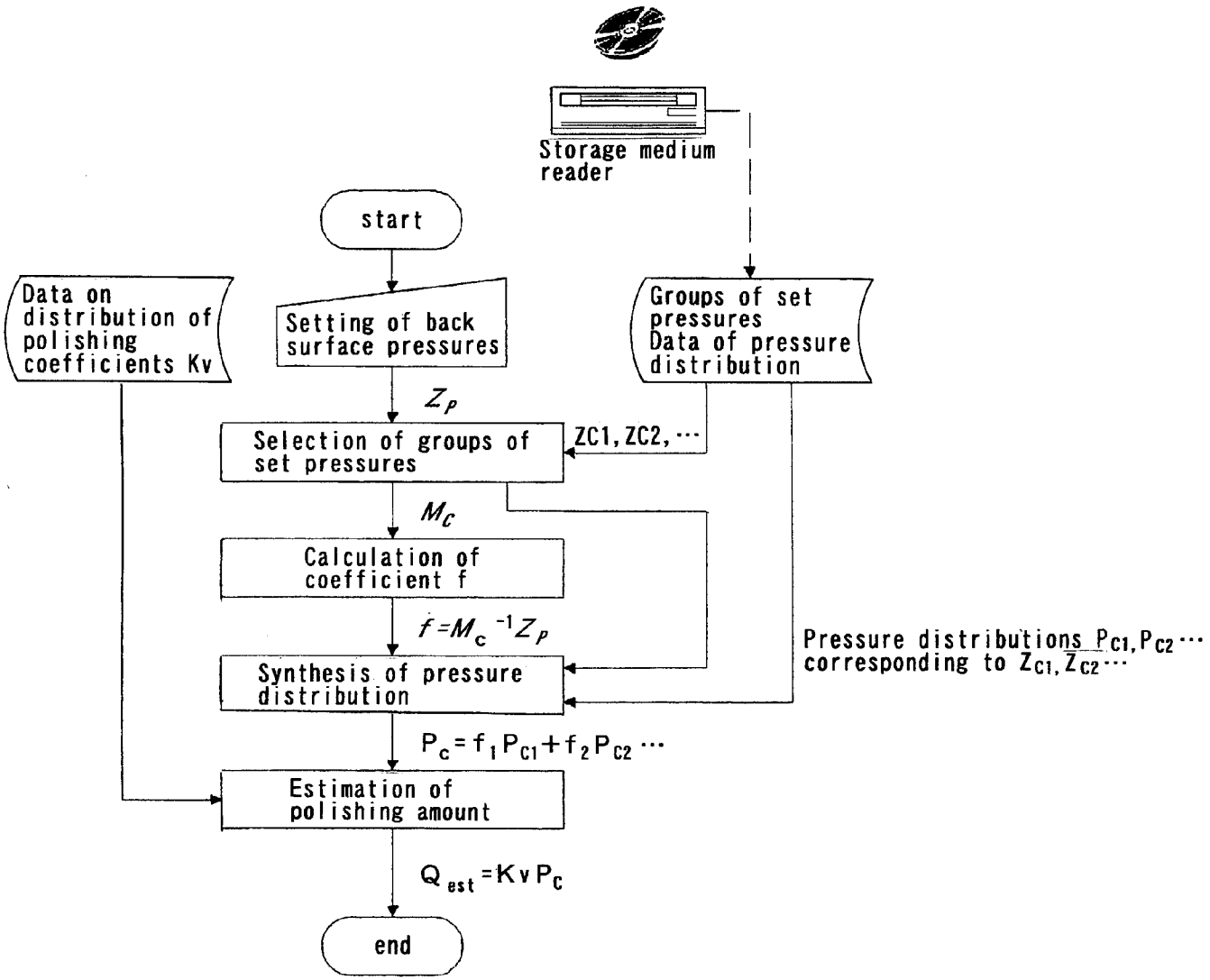
FIG. 6 is a program flow chart of a simulation tool.
Figure 8:
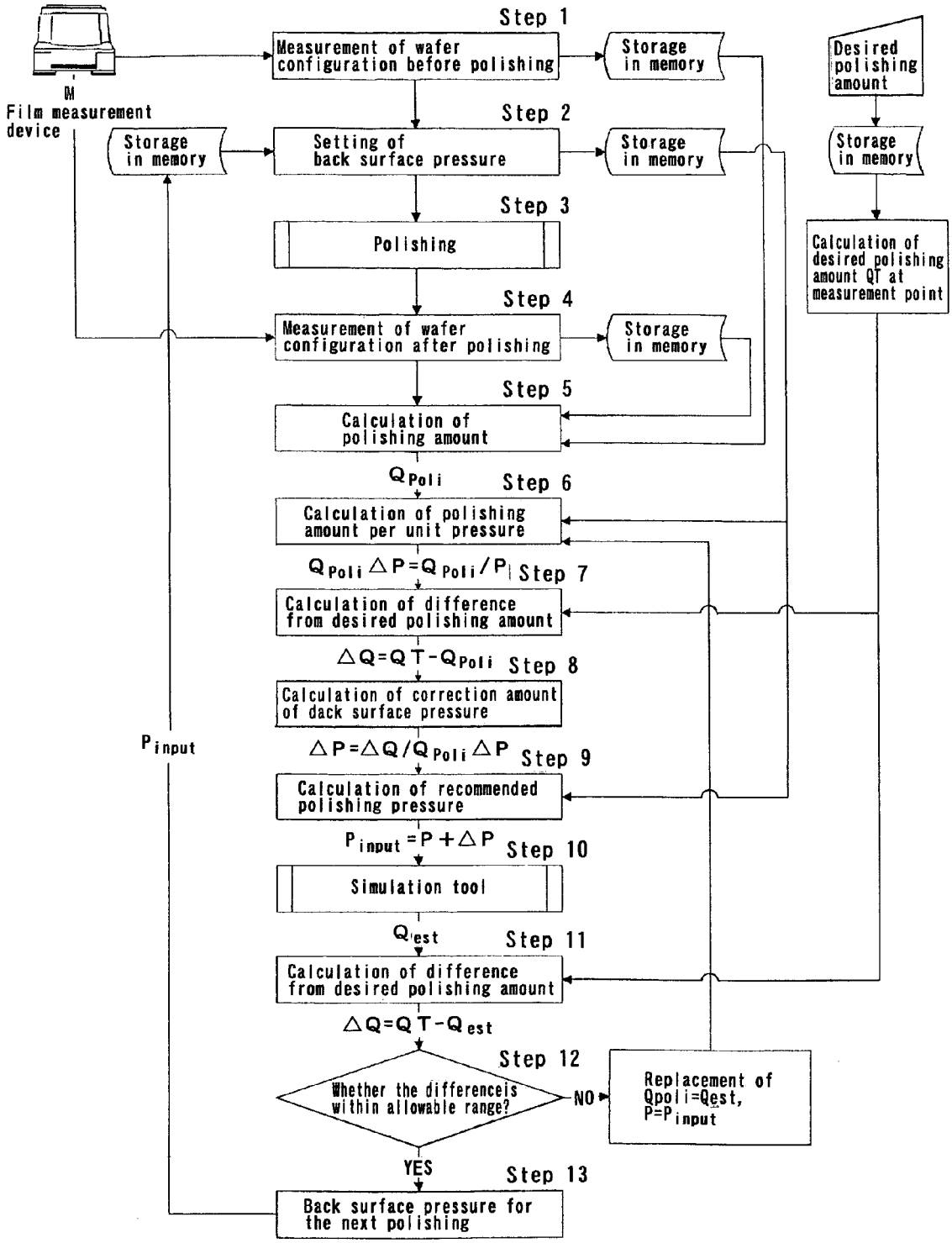
FIG. 8 is a control flow chart according to the present invention.

The "polishing" in step 3 shown in FIG. 8 involves calling up a conventional control program of the polishing apparatus, while the "simulation tool" in step 10 involves calling up the program of the simulation tool shown in FIG. 6. By thus reading a program from a storage medium reader into a conventional control unit CU of a polishing apparatus and calling up the conventional control function of the polishing apparatus, it becomes possible to add the function of the present invention to a conventional polishing apparatus.

The feedback cycle can be set arbitrarily. For example, a method can be employed which involves performing a measurement for every wafer and feeding back estimation results to a next wafer to be polished. According to another usable method, the estimation results are not fed back when wear of a polishing member is small because of small change in the polishing profile, and are fed back after the wear of the polishing member has reached a certain high level. In the latter method, measurement may be performed for arbitrarily selected wafers, and application of particular polishing conditions fed back after the measurement of a selected wafer may be continued until a next measurement of another selected wafer. The feedback cycle may be shortened as wear of the polishing member progresses.

In a case of setting polishing rate instead of polishing amount, the polishing amount $Q_{Poli}$ is divided by polishing time t in step 6. Further, in a case of taking account of polishing rate, the above-described relationship with the distance r and the relative velocity difference Δω may be employed. Polishing conditions (polishing pressure, polishing time, polishing rate), which can provide a desired polishing profile, can thus be determined by using the simulation tool.

When a failure occurs in the polishing apparatus, or a polishing member (consumable member) wears out and reaches its use limit, a desired polishing profile may not be obtained even if the polishing conditions are adjusted. In a case where the polishing amount difference ΔQ between the estimated polishing amount and the target polishing amount, calculated in step 7, changes extremely from a previous calculation, or the recommended polishing pressure $P_{input}$ falls outside a range feasible with the polishing apparatus, operation of the polishing apparatus can be stopped or a warning can be issued. Conventionally, a polishing member (consumable member) is changed with a new one after its use in a certain number of polishing runs so as not to adversely affect device performance. According to the present invention, it becomes possible to use a polishing member to its use limit without being influenced by a number of polishing runs, thus decreasing a frequency of change of the polishing member. Further, the present invention can be used also for failure diagnosis, and can therefore increase a yield of polished products.

Instead of correction of a polishing coefficient made in consideration of the influence of the edge configuration of a wafer, it is possible to correct the back surface pressure based on the results of measurement of the edge configuration after the calculation of the recommended pressure value so as to correct the polishing profile of the edge portion. This can reduce variation of polishing in the peripheral regions of wafers due to variation of edge configurations. For example, in a case of a wafer having a surface oxide film, a recommended polishing pressure value of the outermost retainer ring E5 may be multiplied by a pressure correction coefficient according to the degree of roll-off (corrected retainer ring pressure value=pressure correction coefficient×recommended retainer ring pressure value). The pressure correction coefficient can be created, for example, by actually polishing wafers having known roll-off values with various retainer ring pressures in advance. Alternatively, the pressure correction coefficient may be created by calculating a relationship between the pressure and the degree of roll-off by a finite element method.

The degree of roll-off of a wafer momentarily changes during polishing, due to polishing of the wafer. Accordingly, it is possible to correct the pressure during polishing by measuring the degree of roll-off during polishing with a measuring device installed in the polishing apparatus. The pressure can be corrected without measurement of the degree of roll-off during polishing by creating a pressure correction coefficient also taking polishing time into consideration.

In a case of a wafer having a surface metal film, a configuration of an end portion of the metal film can be corrected by the same method as the above-described method for correcting the roll-off of an oxide film. The method for correcting an edge configuration with a pressure correction coefficient is also applicable to a case of not performing the above-described calculation of recommended pressure values.

The polishing apparatus, by replacement of its top ring, can be applied to a variety of polishing objects. When a top ring is replaced with another one to change a polishing object with another one, it is generally necessary to change a group of pressures (pressure distribution) of the front surface of the former polishing object, the pressures having been calculated for the polishing object according to the configuration of the former top ring, with another group of pressures (pressure distribution) calculated for the latter polishing object according to a configuration of the later top ring. This new data setting may be performed by reading calculation results of a group of set pressures and pressure distribution data from a computer-readable storage medium, as described above. It is also possible to input parameters, such as a number of the air bags of the top ring, their pressure ranges, and the like, upon a start-up of the polishing apparatus, calculate pressure distributions of the front surface of the polishing object, corresponding to the parameters, within the polishing apparatus, and store this data in the control unit.

As described hereinabove, it is possible with the present invention to formulate not only a recipe for flatly polishing an object but also a recipe for polishing an object into a particular configuration. Thus, even when a surface topology of a film on a wafer before polishing is not flat, a recipe can be formulated which, in consideration of the topology, can provide a remaining film after polishing with a flat surface. Further, unlike the conventional practice of optimizing polishing conditions by resorting to an Engineer's empirical rule, the present invention makes it possible to calculate optimum polishing conditions for providing a desired polishing profile. As compared to the conventional adjustment method of polishing a number of test wafers before setting polishing conditions, the present invention can save labor, time and cost. Furthermore, by reading a program according to the present invention into a computer for controlling a polishing apparatus, it becomes possible to add a new function to the polishing apparatus and respond to enhancement of performance by replacement of a top ring.

What is claimed is:

1. A polishing apparatus comprising:

a top ring for holding an object to be polished and rotating the object while pressing a front surface of the object against a polishing surface, said top ring having at least two pressing portions each capable of independently applying a desired pressure on a back surface of the object, wherein, when a desired polishing profile of the object is set and an estimated polishing profile of the object is determined based on set pressure values, with a recommended polishing pressure value being calculated so that a difference between the desired polishing profile and the estimated polishing profile becomes within a predetermined range, said top ring is to press the front surface of the object against the polishing surface so as to polish the object under a polishing condition including the recommended polishing pressure value.

2. The polishing apparatus according to claim 1, wherein when an actual polished profile is measured after the object is polished and corrected pressure values are calculated based on a difference between the actual polished profile and the estimated polishing profile, said top ring is to press the front surface of a next object against the polishing surface so as to polish the next object under a polishing condition including a polishing pressure value based on the corrected pressure values.

3. The polishing apparatus according to claim 1, wherein when an actual polished profile is measured in a predetermined interval and corrected pressure valves are calculated based on a difference between the actual polished profile and the estimated polishing profile, said top ring is to press the front surface of a next object against the polishing surface so as to polish the next object under a polishing condition including a polishing pressure value based on the corrected pressure values.

4. The polishing apparatus according to claim 1, wherein when an actual polished profile is measured after the object is polished and corrected pressure values are calculated based on a difference between the actual polished profile and the estimated polishing profile, said top ring is to press the front surface of a next object against the polishing surface so as to polish the next object under a polishing condition including a polishing pressure value based on the corrected pressure values when a difference between the actual polished profile and the desired polishing profile is within a preset allowable range.

5. The polishing apparatus according to claim 1, wherein when an actual polished profile is measured in a predetermined interval and corrected pressure values are calculated based on a difference between the actual polished profile and the estimated polishing profile, said top ring is to press the front surface of a next object against the polishing surface so as to polish the next object under a polishing condition including a polishing pressure value based on the corrected pressure values when a difference between the actual polished profile and the desired polishing profile is within a preset allowable range.

6. The polishing apparatus according to claim 1, wherein said polishing apparatus is constructed and arranged to have polishing of the object stopped or a warning issued when the recommended polishing pressure value falls outside a predetermined allowable range.

7. The polishing apparatus according to claim 1, further comprising:

a computer for controlling said top ring, said computer including a storage medium reader for reading a program or data from a computer readable storage medium into said computer.

8. A program recorded on a computer readable storage medium, said program for causing a computer to control an apparatus, including a top ring having pressing portions for holding an object to be polished and pressing the object against a polishing surface, to perform operations of:

(a) setting a desired polishing profile;

(b) independently setting a pressure value for each of at least two of the pressing portions, which pressure value corresponds to a pressure that a respective one of each of the at least two pressing portions is to apply on a back surface of the object;

(c) determining an estimated polishing profile of the object based on the pressure values set in (b);

(d) calculating a difference between the desired polishing profile and the estimated polishing profile;

(e) repeating (b)–(d) until the difference between the desired polishing profile and the estimated polishing profile becomes within a predetermined range;

(f) determining a recommended polishing pressure value such that the difference between the desired polishing profile and the estimated polishing profile becomes within the predetermined range, which recommended polishing pressure value corresponds to a pressure that is to be applied by the top ring to the back surface of the object; and (g) polishing the object by causing the top ring to press a front surface of the object against the polishing surface under a polishing condition including the recommended polishing pressure value.

9. The program according to claim 8, wherein the program is also for causing the computer to control the apparatus to perform an operation of stopping polishing of the object or issuing a warning when the recommended polishing pressure falls outside a predetermined allowable range.

10. A computer useable medium having means for storing the program according to claim 8.

11. A program recorded on a computer readable storage medium, said program for causing a computer to control an apparatus, including a top ring having pressing portions for holding an object to be polished and pressing the object against a polishing surface, to perform operations of:

(a) independently setting a pressure value for each of at least two of the pressing portions, which pressure value corresponds to a pressure that a respective one of each of the at least two pressing portions is to apply on a back surface of the object;

(b) determining an estimated polishing profile of the object based on the pressure values set in (a);

(c) measuring an actual polished profile after the object is polished;

(d) calculating corrected pressure values based on a difference between the actual polished profile and the estimated polishing profile; and (e) using the corrected pressure values for a next object to be polished.

12. The program according to claim 11, wherein the program is for causing the computer to control the apparatus to use the corrected pressure values for a next object to be polished when a difference between the actual polished profile and the desired polishing profile is within a preset allowable range.

13. The program according to claim 11, wherein the program is also for causing the computer to control the apparatus to perform an operation of stopping polishing of the object or issuing a warning when the recommended polishing pressure falls outside a predetermined allowable range.

14. A computer useable medium having means for storing the program according to claim 11.

15. A program recorded on a computer readable storage medium, said program for causing a computer to control an apparatus, including a top ring having pressing portions for holding an object to be polished and pressing the object against a polishing surface, to perform operations of:

(a) independently setting a pressure value for each of at least two of the pressing portions, which pressure value corresponds to a pressure that a respective one of each of the at least two pressing portions is to apply on a back surface of the object;

(b) determining an estimated polishing profile of the object based on the pressure values set in (a);

(c) measuring an actual polished profile in a predetermined interval;

(d) calculating corrected pressure values based on a difference between the actual polished profile and the estimated polishing profile; and (e) using the corrected pressure values for a next object to be polished.

16. The program according to claim 15, wherein the program is for causing the computer to control the apparatus to use the corrected pressure values for a next object to be polished when a difference between the actual polished profile and the desired polishing profile is within a preset allowable range.

17. The program according to claim 15, wherein the program is also for causing the computer to control the apparatus to perform an operation of stopping polishing of the object or issuing a warning when the recommended polishing pressure falls outside a predetermined allowable range.

18. A computer useable medium having means for storing the program according to claim 15.

19. A method for estimating a polishing profile or a polishing amount when polishing an object by using a top ring to press a front surface of the object against a polishing surface, with the top ring having at least two pressing portions each capable of independently applying a desired pressure on a back surface of the object, said method comprising:

setting back surface pressure distributions of the object;

calculating front surface pressure distributions of the object corresponding to said back surface pressure distributions;

storing said back surface pressure distributions and said front surface pressure distributions in a memory medium so as to provide stored back surface pressure distributions and stored front surface pressure distributions;

setting a desired back surface pressure distribution of the object;

synthesizing said desired back surface pressure distribution from a combination of said stored back surface pressure distributions;

calculating a desired front pressure distribution corresponding to said desired back surface pressure distribution based on a combination of said stored back surface pressure distributions;

calculating an estimated polishing profile or polishing amount of the object based on said desired front pressure distribution and a predetermined equation which includes a polishing amount value and a pressure value as parameters; and determining set pressure values that provide a desired polishing profile, by (a) determining a difference in a polishing amount between a polishing profile of the object during polishing and said estimated polishing profile, (b) correcting said desired front pressure distribution based on the difference in polishing amount so as to provide a corrected front pressure distribution, (c) determining an estimated polishing profile as obtained by said corrected desired front pressure distribution, and (d) repeating (a)–(c) until a difference between a polishing profile of the object during polishing and said estimated polishing profile determined in (c) becomes within a predetermined range.

20. A method for estimating a polishing profile or a polishing amount when polishing an object by using a top ring to press a front surface of the object against a polishing surface, with the top ring having at least two pressing portions each capable of independently applying a desired pressure on a back surface of the object, said method comprising:

setting back surface pressure distributions of the object;

calculating front surface pressure distributions of the object corresponding to said back surface pressure distributions;

storing said back surface pressure distributions and said front surface pressure distributions in a memory medium so as to provide stored back surface pressure distributions and stored front surface pressure distributions;

setting a desired back surface pressure distribution of the object;

synthesizing said desired back surface pressure distribution from a combination of said stored back surface pressure distributions;

calculating a desired front pressure distribution corresponding to said desired back surface pressure distribution based on a combination of said stored back surface pressure distributions;

calculating an estimated polishing profile or polishing amount of the object based on said desired front pressure distribution and a predetermined equation which includes a polishing amount value and a pressure value as parameters; and updating said estimated polishing profile based on a measured polishing profile of the object.

21. A method for estimating a polishing profile or a polishing amount when polishing an object by using a top ring to press a front surface of the object against a polishing surface, with the top ring having at least two pressing portions each capable of independently applying a desired pressure on a back surface of the object, said method comprising:

setting back surface pressure distributions of the object;

calculating front surface pressure distributions of the object corresponding to said back surface pressure distributions;

storing said back surface pressure distributions and said front surface pressure distributions in a memory medium so as to provide stored back surface pressure distributions and stored front surface pressure distributions;

setting a desired back surface pressure distribution of the object;

synthesizing said desired back surface pressure distribution from a combination of said stored back surface pressure distributions;

calculating a desired front pressure distribution corresponding to said desired back surface pressure distribution based on a combination of said stored back surface pressure distributions; and calculating an estimated polishing profile or polishing amount of the object based on said desired front pressure distribution, a predetermined equation which includes a polishing amount value and a pressure value as parameters, and results of measurement of a configuration of a polished object performed by a configuration monitor capable of measuring an edge configuration of the polished object.

22. A method for polishing an object by using a polishing apparatus including a top ring having pressing portions to press a back surface of the object such that a front surface of the object is pressed against a polishing surface, said method comprising:

(a) setting a desired polishing profile;

(b) independently setting a pressure value for each of at least two of the pressing portions, which pressure value corresponds to a pressure that a respective one of each of the at least two pressing portions is to apply on a back surface of the object;

(c) determining an estimated polishing profile of the object based on the pressure values set in (b);

(d) calculating a difference between said desired polishing profile and said estimated polishing profile;

(e) repeating (b)–(d) until the difference between said desired polishing profile and said estimated polishing profile becomes within a predetermined range;

(f) determining a recommended polishing pressure value such that the difference between said desired polishing profile and said estimated polishing profile becomes within the predetermined range, which recommended polishing pressure value corresponds to a pressure that is to be applied by the top ring to the back surface of the object; and (g) polishing the object by causing the top ring to press a front surface of the object against the polishing surface under a polishing condition including said recommended polishing pressure value.

23. The method according to claim 22, further comprising:

measuring an actual polished profile after the object is polished;

calculating corrected pressure values based on a difference between said actual polished profile and said estimated polishing profile; and using said corrected pressure values for a next object to be polished.

24. The method according to claim 23, wherein using said corrected pressure values for a next object to be polished comprises using said corrected pressure values when a difference between said actual polished profile and said desired polishing profile is within a preset allowable range.

25. The method according to claim 22, further comprising:

measuring an actual polished profile of the object in a predetermined interval;

calculating corrected pressure values based on a difference between said actual polished profile and said estimated polishing profile; and using said corrected pressure values for a next object to be polished.

26. The method according to claim 25, wherein using said corrected pressure values for a next object to be polished comprises using said corrected pressure values when a difference between said actual polished profile and said desired polishing profile is within a preset allowable range.

27. The method according to claim 22, further comprising:

stopping polishing of the object or issuing a warning when said recommended polishing pressure value falls outside a predetermined allowable range.

* * * * *